US006428945B1

(12) United States Patent
Lin et al.

(10) Patent No.: US 6,428,945 B1
(45) Date of Patent: Aug. 6, 2002

(54) METHOD OF FORMING BARRIER RIBS USED IN A PLASMA DISPLAY PANEL

(75) Inventors: Chien-Ho Lin, Hsinchu; Chung-Wang Chou, Taoyuan Hsien, both of (TW)

(73) Assignee: Au Optronics Corp., Hsinchu (TW)

( * ) Notice: Subject to any disclaimer, the term of this patent is extended or adjusted under 35 U.S.C. 154(b) by 0 days.

(21) Appl. No.: 09/955,705

(22) Filed: Sep. 19, 2001

(30) Foreign Application Priority Data

Feb. 13, 2001 (TW) ..... 90103121 A

(51) Int. Cl.[7] ..... H01J 9/00
(52) U.S. Cl. ..... 430/321; 430/323; 445/24
(58) Field of Search ..... 430/320, 321, 430/323; 445/24; 313/582, 584, 586

(56) References Cited

U.S. PATENT DOCUMENTS 5,990,617 A * 11/1999 Kanae et al. ..... 313/582

FOREIGN PATENT DOCUMENTS

JP 4-282531 A * 10/1992
JP 5-128966 A * 5/1993

* cited by examiner

*Primary Examiner*—John A. McPherson
(74) *Attorney, Agent, or Firm*—Ladas & Parry

(57) ABSTRACT

A method of forming barrier ribs used in plasma display panels (PDP) is provided. The barrier ribs are formed on a substrate, and the substrate includes a dielectric layer and a rib material layer formed on the dielectric layer. First, a first bottom pattern layer, a second bottom pattern layer and a third bottom pattern layer are formed on the rib material layer. These bottom pattern layers have the same width and are spaced apart to each other with the same distance. Second, a first middle pattern layer, a second middle pattern layer, and a third middle pattern layer are respectively formed above the first bottom pattern layer, the second bottom pattern layer, and the third bottom pattern layer. The left sidewalls of the first middle pattern layer and the first bottom pattern layer are aligned, the right sidewalls of the second middle pattern layer and the second bottom pattern layer are aligned, and the two sidewalls of the third middle pattern layer and the third bottom pattern layer are respectively aligned. Then, a first top pattern layer, and a second top pattern layer are respectively formed above the first middle pattern layer and the third middle pattern layer. The left sidewall of the first top pattern layer and the first middle pattern layer is aligned, and the right sidewall of the second top pattern layer and the third middle pattern layer is aligned. Next, a sandblasting process is performed by using the bottom pattern layers, the middle pattern layers, and the top pattern layers as a mask, parts of the rib material layer is removed to exposed parts of the dielectric layer. Finally, the barrier ribs are completed formed by removing the bottom pattern layers, the middle pattern layers, and the top pattern layers.

8 Claims, 8 Drawing Sheets

METHOD OF FORMING BARRIER RIBS USED IN A PLASMA DISPLAY PANEL

BACKGROUND OF THE INVENTION

1. Field of the Invention

The present invention relates to a method of forming barrier ribs in a plasma display panel (PDP) and, more particularly, to a method of forming barrier ribs with different depths.

2. Description of the Related Art

A plasma display panel (PDP) is a thin type display, usually has a large display area and a thin thickness. The luminescent principle of the PDP is the same as that of a fluorescent lamps. A vacuum glass trough is filled with inert gases. When a voltage is applied to the glass trough, some plasma will be occurred to radiate ultraviolet (UV) rays. After the fluorescent materials coated on the wall of the glass trough adsorb the UV rays, the fluorescent materials will radiate visible light including red light, green light and blue light. A plasma display can be viewed as a combination of hundreds of thousands of illuminating units, each illuminating unit has three subunits for radiating red light, green light and blue light, respectively. Images will be showed on the display by mixing these three primary colors.

As shown in FIG. 1, a conventional PDP 10 has a pair of glass substrates 12, 14 arranged in parallel and opposite to each other. A discharge space 16 is formed between the glass substrates 12, 14 and injected with inert gases, such as Ar, Xe or others. The upper glass substrate 12 has a plurality groups of transverse electrodes positioned in parallel. Each group of the transverse electrodes has a first and a second sustaining electrode 18, 20, and each sustaining electrode 18, 20 includes a transparent electrode 181, 201 and a bus electrode 182, 202. A dielectric layer 24 is further formed to cover these transverse electrodes, and a protection layer 26 is formed on the dielectric layer 24.

The lower glass substrate 14 has a plurality of barrier ribs 28 arranged in parallel and spaced a distance to each other for dividing the discharge space 16 into a plurality of group of sub-discharge spaces. Each group of the sub-discharge spaces includes a red discharge space 16R, a green discharge space 16G, and a blue discharge space 16B. Also, the lower glass substrate 14 has a plurality of lengthwise electrodes 22 positioned in parallel and between two adjacent barrier ribs 28 to serve as address electrodes. In addition, a red fluorescent layer 29R, a green fluorescent layer 29G, and a blue fluorescent layer 29B will be respectively coated on the lower glass substrate 14 and the sidewalls of the barrier ribs 28 within each red discharge space 16R, each green discharge space 16G, and each blue discharge space 16B.

When a voltage applied for driving these electrodes, the inert gases in the discharge space 16 will be discharged to produce UV rays. The UV rays further illuminate the fluorescent layers 29R, 29G, 29B to radiate visible lights including red light, green light and blue light. After the three primary colors are mixed at different ratios, various images are formed and transmitted through the upper glass substrate 12.

Considering the illuminant characteristics and the color purities of these three primary colors, some specific materials are used in the fluorescent layers 29R, 29G, 29B. For example, the red fluorescent layer 29R is formed by mixing $Eu^{+3}$ and $(Y,Gd)BO_3$, or Eu and $Y_2O_3$. The green fluorescent layer 29G is formed by mixing Mn and $Zn_2SiO_4$ or Mn and $BaAl_{12}O_{19}$. The blue fluorescent layer 29B is formed by mixing $Eu^{+2}$ and $BaMgAl_{14}O_{23}$, or by $Eu^{+2}$ and $SrMg(SiO_4)_2$. However, the fluorescent materials still have some disadvantages. For example, the lifetime of the blue fluorescent materials is too short, and the residual light produced by the green fluorescent materials exists too long. Therefore, the color temperature of the prior PDP 10 is too low, resulting in a poor quality of the display. In order to improve the quality, the widths of different discharge space are varied. The width of the blue discharge space is the biggest so as to increase the blue discharge space 16B to the maximum space. Thereby, the surface area of the blue fluorescent layer 29B can be increased to improve the property of blue light. Further, the color temperature of the PDP 10 can be increased to improve the quality of the display. However, the width of the red discharge space 16R may be reduced too much, and therefore, the processes of manufacturing the barrier ribs 28 and coating the red fluorescent layer 29R become more difficult. An alignment problem of the glass substrates 12, 14 is encountered because the width of the red discharge space 16R is small. In addition, the discharged gases may be flowed to the neighbor cells to cause a "cross-talk" phenomenon when the width of the red discharge space 16R is narrow. The electrical properties of the PDP 10 are then changed. In order to solve the problems described above, a method of forming the PDP with a high color temperature should be disclosed.

SUMMARY OF THE INVENTION

The present invention is a method of forming barrier ribs of a PDP with different depths of the discharge spaces.

The barrier ribs are formed on a substrate having a plurality of electrodes, a dielectric layer above the electrodes and the substrate, and a rib material layer on the dielectric layer. First, a first bottom pattern layer, a second bottom pattern layer and a third bottom pattern layer are formed above the rib material layer. These bottom pattern layers have the same width and are spaced apart to each other with the same distance. Second, a first middle pattern layer, a second middle pattern layer and a third middle pattern layer are respectively formed on the first bottom pattern layer, the second bottom pattern layer and the third bottom pattern layer. The left sidewalls of the first middle pattern layer and the first bottom pattern layer are aligned. The right sidewalls of the second middle pattern layer and the second bottom pattern layer are aligned. Both of the right and left sidewalls of the third middle pattern layer and the third bottom pattern layer are respectively aligned. Then, a first top pattern layer and a second top pattern layer are respectively formed on the first middle pattern layer and the third middle pattern layer. The left sidewalls of the first top pattern layer and the first middle pattern layer are aligned. The right sidewalls of the second top pattern layer and the third middle pattern layer are aligned. Next, a sandblasting process is performed by using the bottom pattern layers, the middle pattern layers, and the top pattern layers as a mask, so that parts of the rib material layer are removed to expose parts of the dielectric layer. Finally, the barrier ribs are formed after removing the bottom pattern layers, the middle pattern layers, and the top pattern layers.

Accordingly, it is a principle object of the invention to provide the barrier ribs with different depths.

It is another object of the invention to adjust the surface areas of fluorescent materials coated on different discharge spaces.

Yet another object of the invention is to adjust the depths of different discharge spaces.

It is a further object of the invention to increase the color temperature of the PDP.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
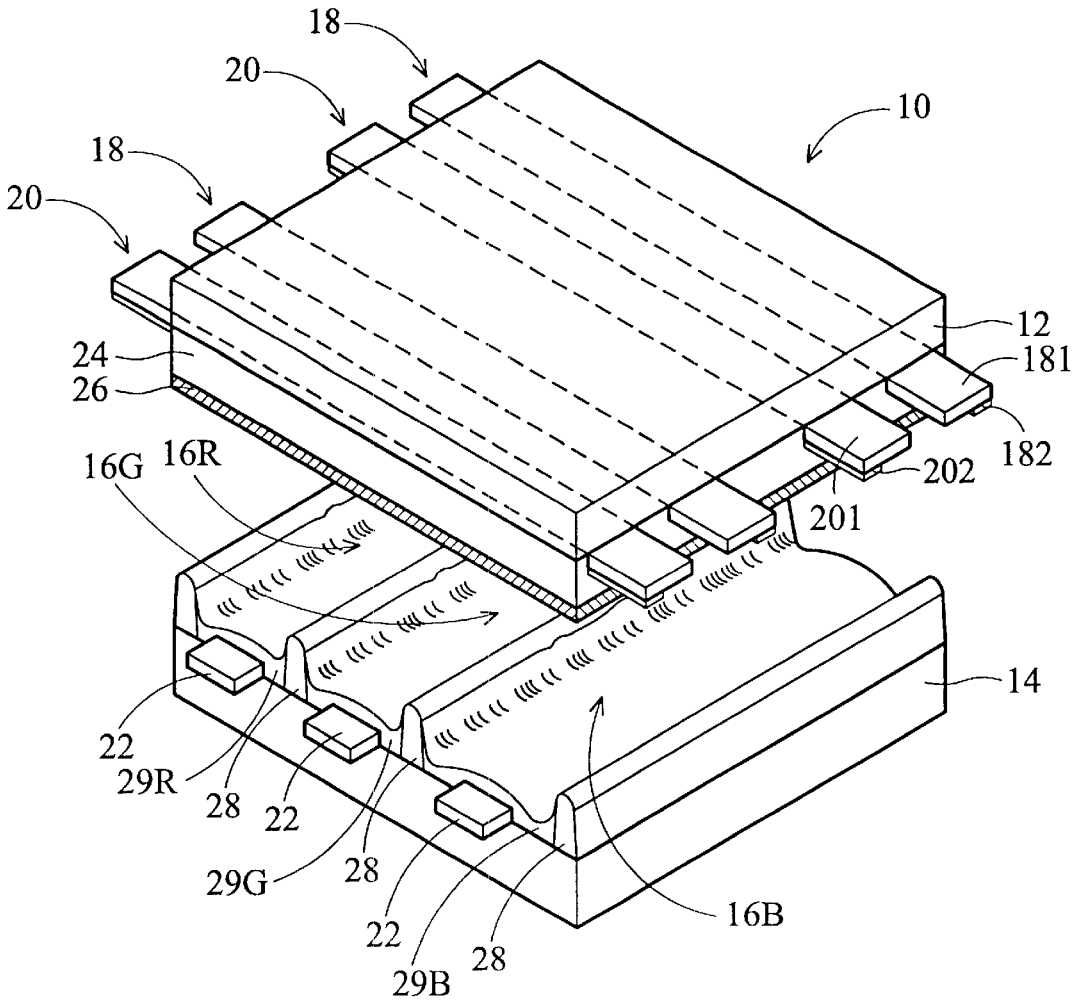
FIG. 1 ( PRIOR ART )
FIG. 1 is a schematic diagram of a PDP 10 according to the prior art.
Figure 2:
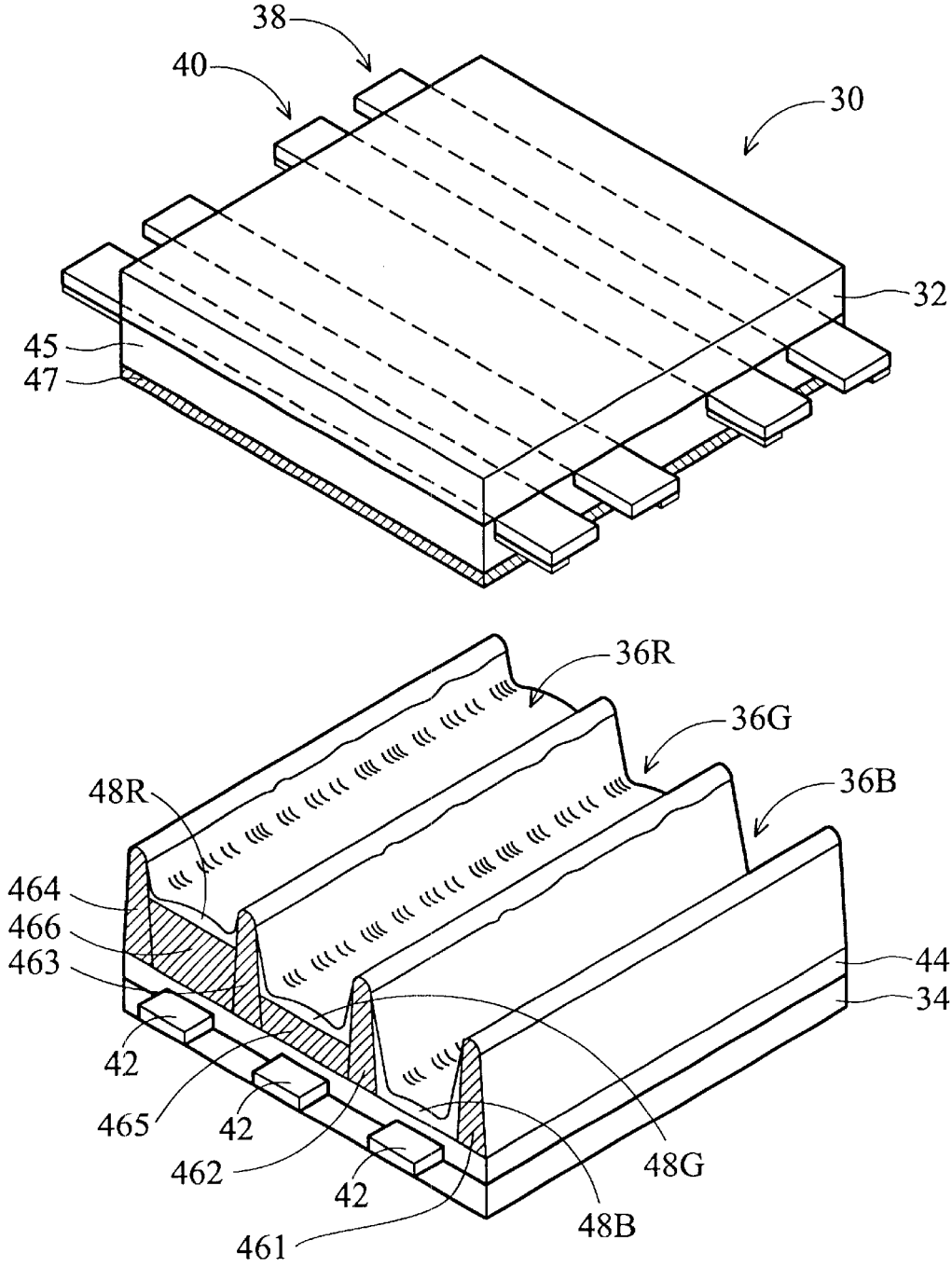
FIG. 2 is a schematic diagram of a PDP 30 according to the present invention.

FIG. 2 is a schematic diagram of a PDP 30 according to the present invention. The PDP 30 is formed by a pair of glass substrates 32, 34 arranged in parallel and opposite to each other. A space is formed between the glass substrates 32, 34 as a discharge space 36, and the discharge space 36 is injected with inert gases, such as Ar, Xe or others. The upper glass substrate 32 includes a plurality of groups of transverse electrodes arranged in parallel. Each group of the transverse electrodes has a first and a second sustaining electrode 38 and 40, and each sustaining electrode 38, 40 has a transparent electrode and a bus electrode. Besides, a first dielectric layer 45 is formed to cover the transverse electrodes, and a protection layer 47 is further formed above the first dielectric layer 45.

The lower glass substrate 34 has a plurality of address electrodes 42 positioned in parallel, a second dielectric layer 44 formed on the address electrodes 42, and a plurality of barrier ribs 46 formed on the second dielectric layer 44. The address electrodes are formed vertically to the transverse electrodes. The barrier ribs 46 are disposed in parallel and spaced apart to each other with the same distance. A plurality of discharged spaces 36 are formed between these barrier ribs 46. A first barrier rib 461, a second barrier rib 462, a third barrier rib 463, a fourth barrier rib 464, a first bottom layer 465, and a second bottom layer 466 are formed on the lower glass substrate 34. The blue discharge space 36B is formed between the first barrier rib 461 and the second barrier rib 462 so as to expose the second dielectric layer 44. The green discharge space 36G is defined by the space among the second barrier rib 462, the third barrier rib 463, and the first bottom layer 465. In addition, a red discharge space 36R is defined by the space among the third barrier rib 463, the fourth barrier rib 464, and the second bottom layer 466. The distance between these adjacent barrier ribs 461~464 are equally to each other, the height of each barrier ribs 461~464 is the same, but the thickness of the first bottom layer 465 and the second bottom layer 466 are different, so that the spaces of these discharge spaces 36B, 36G, 36R are different. The thickness of the first bottom layer 465 is larger than that of the second bottom layer 466. No bottom layer is formed in the green discharge space 36G, therefore, the blue discharge space 36B is largest, the green discharge space 36G is next, and the red discharge space 36R is smallest. In the same time, the capacitance of the blue discharge space 36B is increased, and the capacitance of the red discharge space 36R can be decreased.

Accordingly, a blue fluorescent layer 48B is coated on the sidewalls of the first barrier rib 461 and second barrier rib 462, and the surface of the lower substrate 34 between the first and the second barrier ribs 461, 462. A green fluorescent layer 48G is coated on the sidewalls of the second barrier rib 462 and third barrier rib 463, and the surface of the first bottom layer 465. A red fluorescent layer 48R is coated on the sidewalls of the third barrier rib 463 and fourth barrier rib 464, and the surface of the second bottom layer 466. Therefore, the surface area of the blue fluorescent layer 48B in the blue discharge space 36B is the maximum, and the surface area of the red fluorescent layer 48R in the red discharge space 36R is the minimum. In other words, by adjusting the depths of the discharge spaces 36B, 36G, 36B, the problems of the blue and green lights are solved, and the color temperature of the PDP 30 is increased.

Figure 3A:
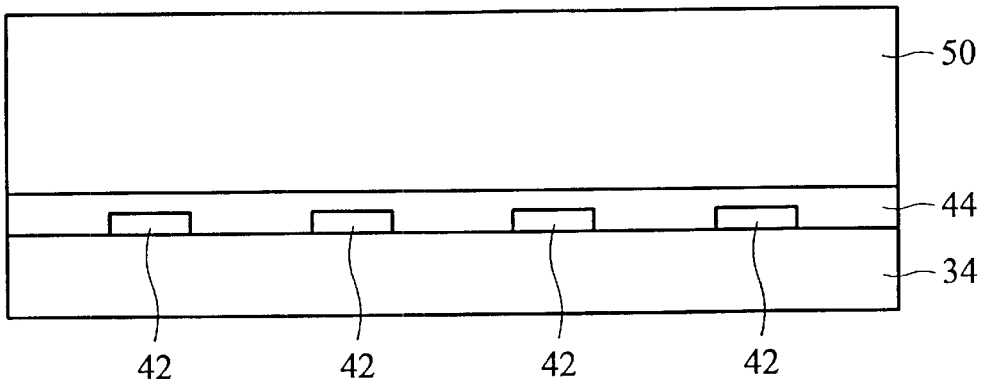
FIGS. 3A to 3I are schematic cross-sectional diagrams showing a method of forming the barrier ribs according to the present invention.
Figure 3B:
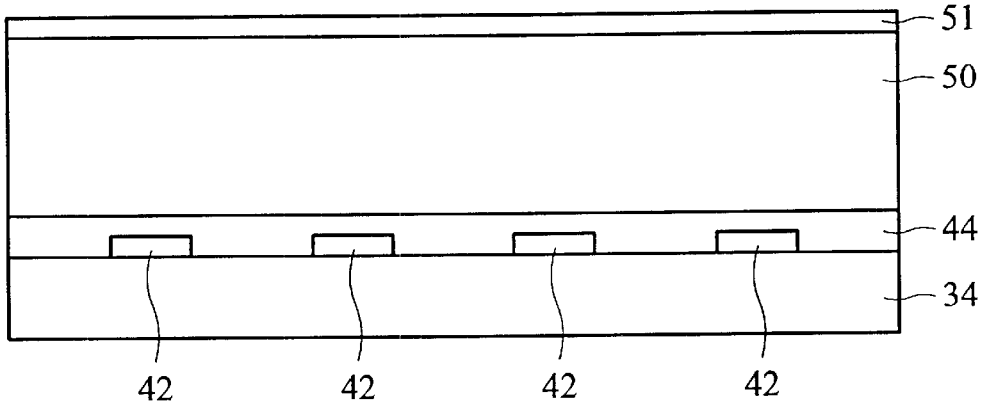
Figure 3C:
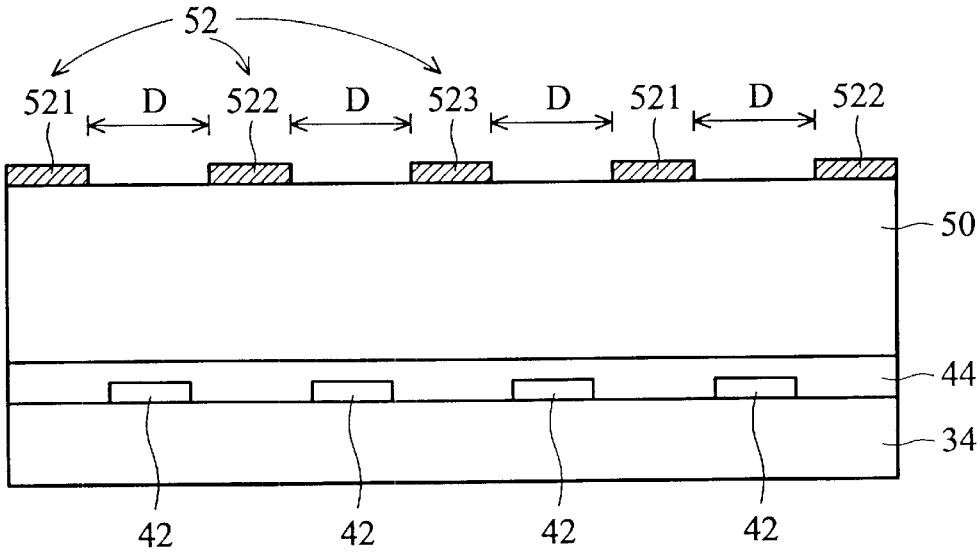

FIGS. 3A to 3I are schematic cross-sectional diagrams showing a method of forming the barrier ribs 46 in the present invention. As shown in FIG. 3A, the lower glass substrate 34 includes a plurality of address electrodes 42 and the second dielectric layer 44. First, a rib material layer 50 consisted of several glass materials with a predetermined thickness is formed on the second dielectric layer 44 by a coating or screen-printing process. Next, as shown in FIG. 3B, a first photosensitive dry-film 51 is formed on the rib material layer 50. As shown in FIG. 3C, after an exposure and development process, the first photosensitive dry-film 51 is patterned to form at least a first bottom pattern layer 521, a second bottom pattern layer 522, and a third bottom pattern layer 523. These bottom pattern layers 521~523 are positioned in parallel, spaced apart to each other by the same distance (D), and have the same widths. These bottom pattern layers 521~523 do not cover the address electrodes 42.

Figure 3D:
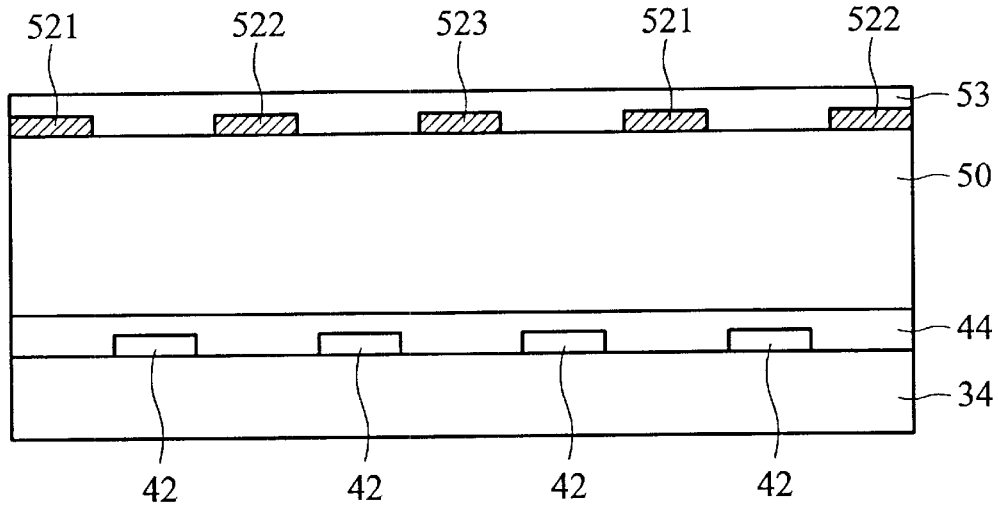
Figure 3E:
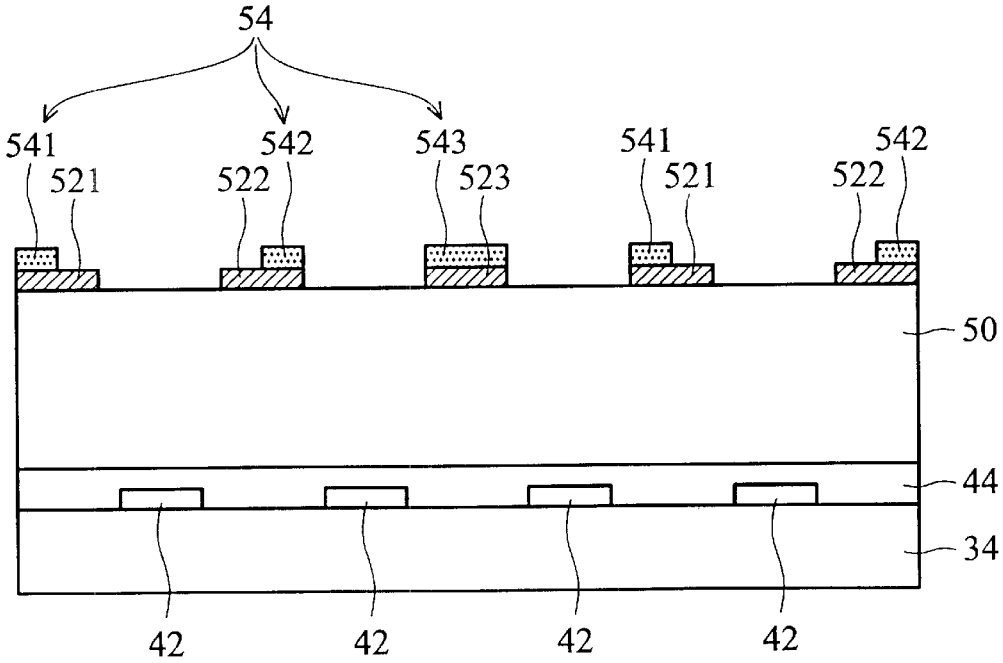

Referring to FIG. 3D, a second photosensitive dry-film 53 is formed on the rib material layer 50 and these bottom pattern layers 521~523. Then, as shown in FIG. 3E, after an exposure and development process, the second photosensitive dry-film 53 is patterned to form at least a first middle pattern layer 541, a second middle pattern layer 542, and a third middle pattern layer 543. These middle pattern layers are positioned in parallel, having different widths, different intervals, and respectively positioned above the first bottom pattern layer 521, the second bottom pattern layer 522, and the third bottom pattern layer 523. The width of the first middle pattern layer 541 is smaller than that of the first bottom pattern layer 521, the left sidewall of the first middle pattern layer 541 is aligned to the left sidewall of the first bottom pattern layer 521 so as to expose the right part of the first bottom pattern layer 521. The width of the second middle pattern layer 542 is smaller than that of the second bottom pattern layer 522, the right sidewall of the second middle pattern layer 542 is aligned to the right sidewall of the second bottom pattern layer 522 so as to expose the left part of the second bottom pattern layer 522. The width of the third middle pattern layer 543 is approximately equal to the width of the third bottom pattern layer 523, and the two sidewalls of the third middle pattern layer 543 are aligned to the two sidewalls of the third bottom pattern layer 523.

Figure 3F:
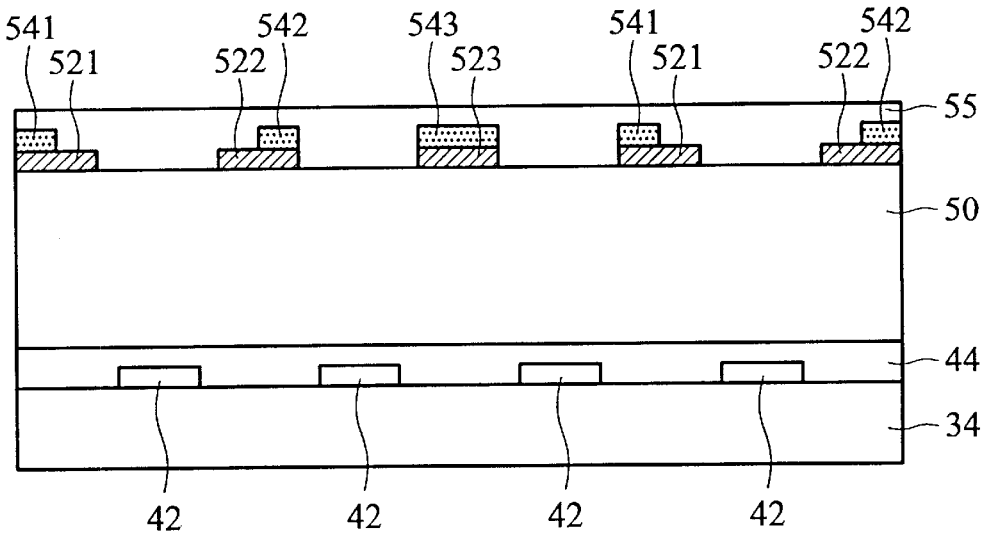
Figure 3G:
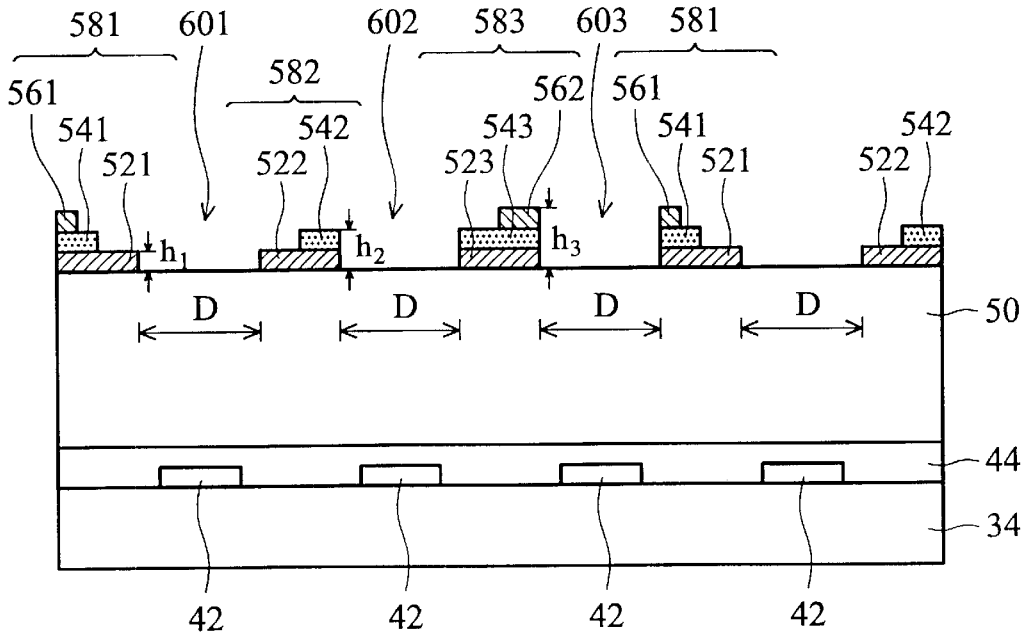
Figure 3H:
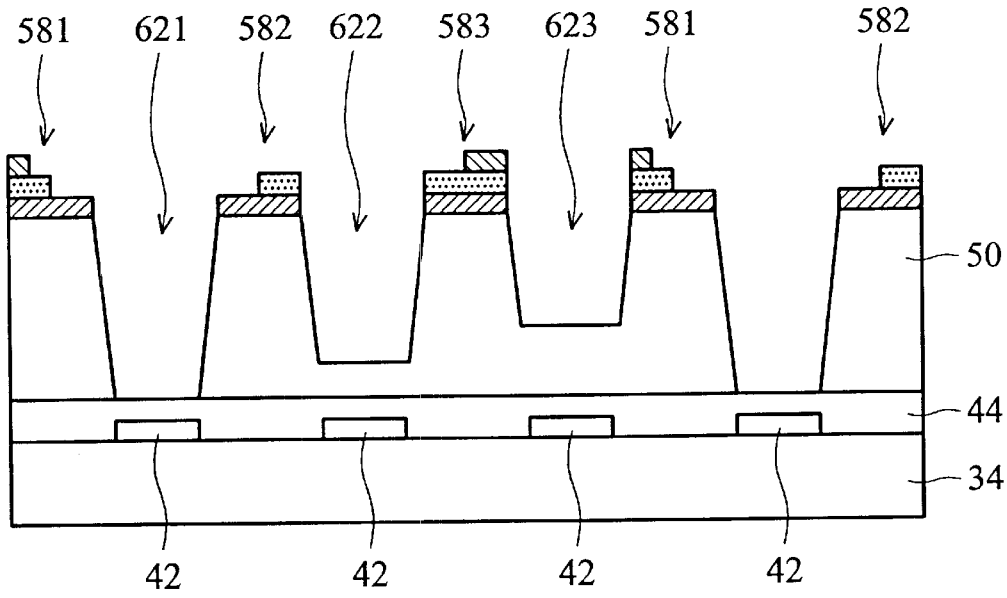

Referring to FIG. 3F, a third photosensitive dry-film 55 is formed. Then, as shown in FIG. 3H, after an exposure and development process, the third photosensitive dry-film 55 is patterned to form at least a first top pattern layer 561 and a second top pattern layer 562. These top pattern layers 561, 562 have different widths and respectively positioned on the first middle pattern layer 541 and the third middle pattern layer 543. The width of the first top pattern layer 561 is smaller than that of the first middle pattern layer 541, and the left sidewall of the first top pattern layer 561 is aligned to the left sidewall of the first middle pattern layer 541 so as to expose the right part of the first middle pattern layer 541. The width of the second top pattern layer 561 is smaller than that of the third middle pattern layer 543, and the right sidewall of the second top pattern layer 562 is aligned to the right sidewall of the third middle pattern layer 543 so as to expose the left part of the third middle pattern layer 543.

Accordingly, a group of masks for patterning the rib material layer 50 are formed. The first bottom pattern layer 521, the first middle pattern layer 541, and the first top pattern layer 561 are defined as a first mask 581. The second bottom pattern layer 522 and the second middle pattern layer 542 are defined as a second mask 582. The third bottom pattern layer 523, the third middle pattern layer 543, and the second top pattern layer 562 are defined as a third mask 583. Therefore, a first trench 601 is formed between the first mask 581 and the second mask 582, a second trench 602 is formed between the second mask 582 and the third mask 583, and a third trench 603 is formed between the third mask 583 and the next first mask 581. These trenches 601~603 have the same width (D=D=D) and different heights ($h_1<h_2<h_3$).

Referring to FIG. 3H, a sandblasting process is performed to remove parts of the rib material layer 50 uncovered by the masks 581~583. Further, a first deep trench 621, a second deep trench 622, and a third deep trench 623 are respectively formed below the first trench 601, the second trench 602, and the third shallow trench 603, and the second dielectric layer 44 is exposed within the first deep trench 621. These masks 581~583 have different heights because of their ladder-shaped sidewalls, so that sands used in the sandblasting process have different resistances, and the intensity of the sandblasting process is decreased. When the second dielectric layer 44 is exposed in the first deep trench 621, the bottoms of the second deep trench 622 and the third deep trench 623 are still the rib material layer 50. Therefore, the bottom of the first deep trench 621 is positioned in the lowest level, the bottom of the second deep trench 622 is positioned in the second level, and the bottom of third deep trench 623 is positioned in the highest level.

Figure 3I:
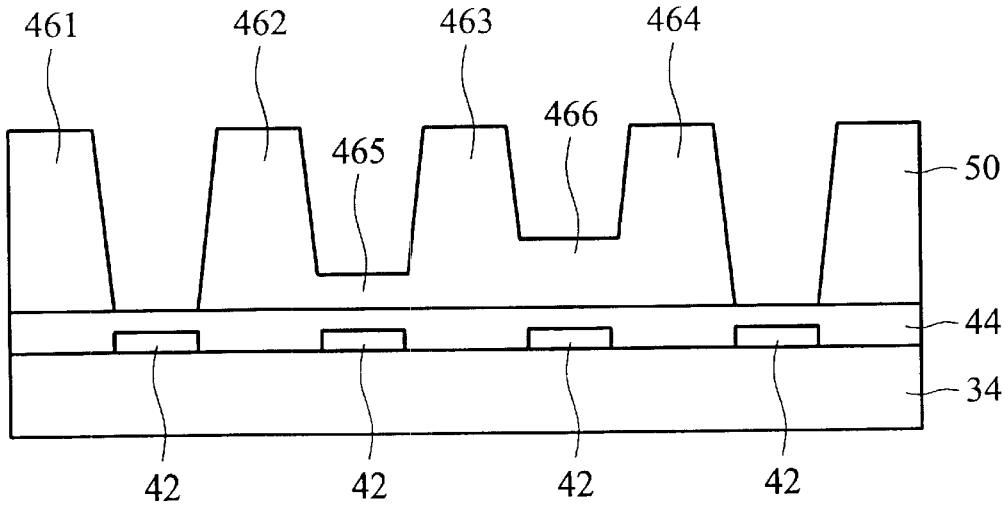

Finally, as shown in FIG. 3I, the masks 581~583 will be removed by a stripping process, the remaining part of the rib material layer 50 will form the barrier rib 46 in the present invention. The first deep trench 621 is the blue discharge space 36B, and surrounding by the first barrier rib 461 and the second barrier rib 462. The second deep trench 622 is the green discharge space 36G, and surrounding by the second barrier rib 462, the first bottom layer 465, and the third barrier rib 463. The third deep trench 623 is the red discharge space 36R, and surrounding by the third barrier rib 463, the second bottom layer, and the fourth barrier rib 464. The surface area of the blue discharge space 36B is the largest, and the surface area of the red discharge space 36R is the smallest. The size of the green discharge space 36G can be equal to the size of the blue discharge space 36B, or smaller than that of the blue discharge space 36B, depending on the process requirement and the limitation of the fluorescent materials.

[Second Embodiment]

Figure 4A:
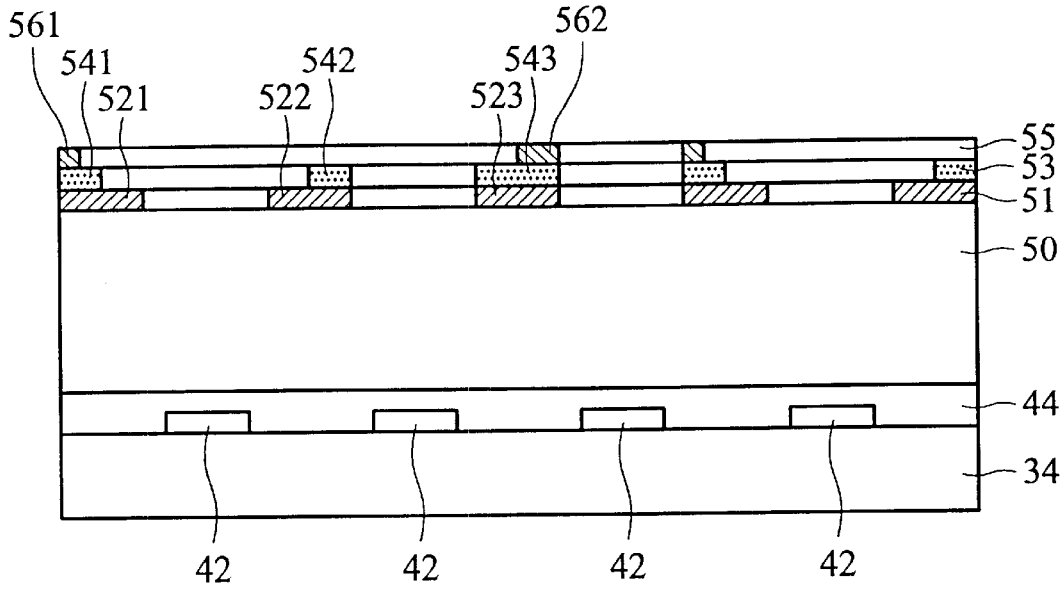
FIGS. 4A to 4C are schematic cross-sectional diagrams showing another method of forming the barrier rib according to the present invention.
Figure 4B:
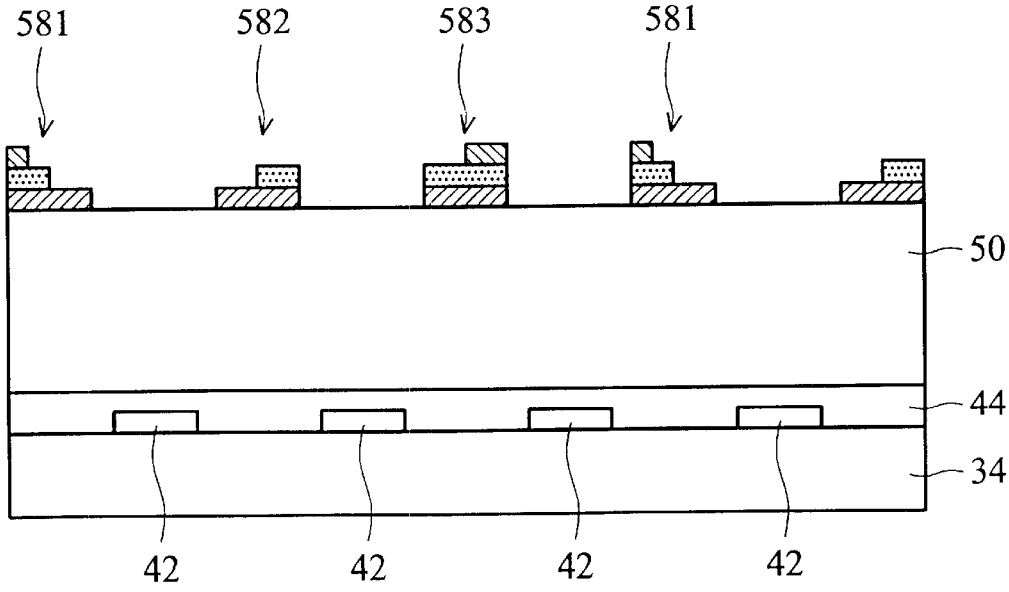
Figure 4C:
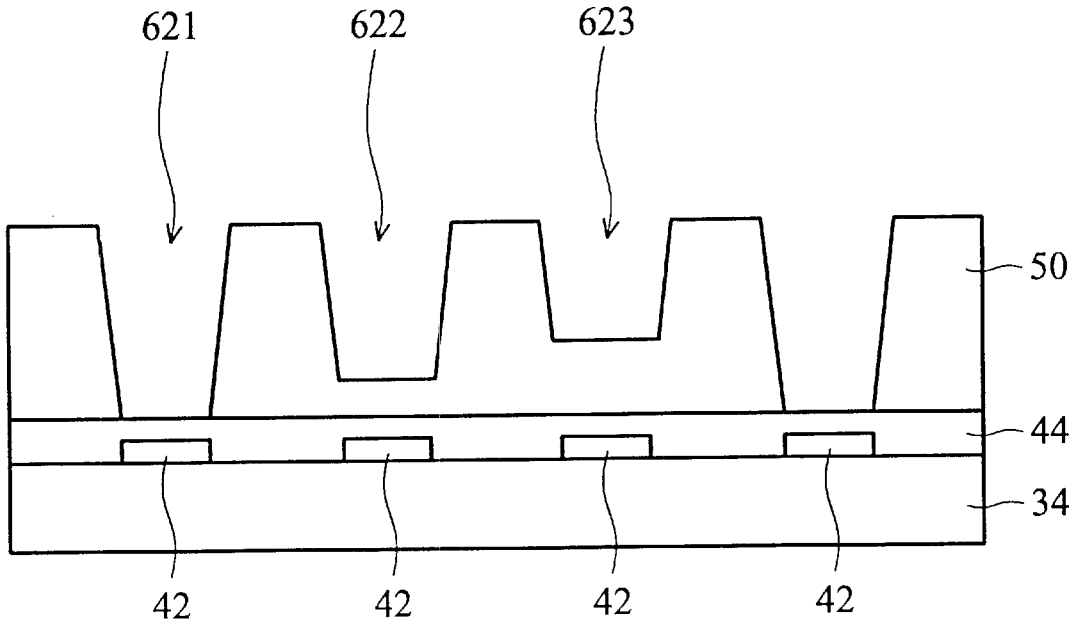

FIGS. 4A to 4C are schematic cross-sectional diagrams showing another method of forming the barrier rib 46 according to the present invention. As shown in FIG. 4A, the first photosensitive dry-film 51 is formed on the rib material layer 50 and then patterned by an exposure process to define these bottom pattern layers 521, 522, 523. Then, the second photosensitive dry-film 53 is formed and then patterned by another exposure process to define these middle pattern layers 541, 542, 543 above these bottom pattern layers 521, 522, 523. Next, the third photosensitive dry-film 55 is formed and then patterned by another exposure process to define these top pattern layers 561, 562 above parts of these middle pattern layers 541, 542, 543. Thereafter, as shown in FIG. 4B, the unexposed regions of the photosensitive dry-films 51, 53 and 55 are removed by only one development process, thus the masks 581, 582, 583 are formed by the bottom pattern layers 52, the middle pattern layers 54, and the top pattern layers 56.

Referring to FIG. 4C, using sandblasting with the masks 581, 582 and 583, the exposed regions of the rib material layer 50 uncovered by the masks 581, 582, 583 are removed by a sandblasting process to form these deep trenches 621, 622, 623 and expose the second dielectric layer 44 in the first deep trench 621. Finally, the barrier ribs 46 are formed after removing the masks 581, 582, 583 by a stripping process. Compared to the first embodiment, only one development process is required in the second embodiment, therefore, the production time and cost will be reduced.

It is to be understood that the present invention is not limited to the embodiments described above, but encompasses any and all embodiments within the scope of the following claims.

What is claimed is:

1. A method of forming a barrier rib of a plasma display panel (PDP), comprising steps of:

(a) providing a substrate having a plurality of electrodes formed on the substrate, a dielectric layer covered the electrodes and the surface of the substrate, and a rib material layer on the dielectric layer;

(b) forming a first bottom pattern layer, a second bottom pattern layer, and a third bottom pattern layer above the rib material layer, each bottom pattern layer having the same width and being spaced apart to each other with the same distance;

(c) forming a first, a second and a third middle pattern layer respectively above the first, the second, and the third bottom pattern layers;

the left sidewall of the first middle pattern layer being aligned to the left sidewall of the first bottom pattern layer for exposing the right part of the first bottom pattern layer; the right sidewall of the second middle pattern layer being aligned to the right sidewall of the second bottom pattern layer for exposing the left part of the second bottom pattern layer; and the two sidewalls of the third middle pattern layer being aligned to the two sidewalls of the third bottom pattern layer;

(d) forming a first and a second top pattern layer above the first and the third middle pattern layers respectively;

the left sidewall of the first top pattern layer being aligned to the left sidewall of the first middle pattern layer for exposing the right part of the first middle pattern layer; the right sidewall of the second top pattern layer being aligned to the right sidewall of the third middle pattern layer for exposing the left part of the third middle pattern layer;

(e) using the bottom, middle, and top pattern layers as a mask, performing a sandblasting process to remove parts of the rib material layer uncovered by the bottom pattern layers, the middle pattern layers and the top pattern layers for exposing parts of the dielectric layer; and (f) removing the bottom pattern layers, the middle pattern layers, and the top pattern layers for forming the barrier rib.

2. The method according to claim 1, wherein the bottom pattern layers are formed in parallel to each other, the middle pattern layers are formed in parallel to each other, the top pattern layers are formed in parallel to each other, and the bottom, middle, top pattern layers are disposed on the substrate and do not overlap with the electrodes.

3. The method according to claim 1, wherein the step (b) comprises the steps of:

(b1) forming a first photo-resist layer above the rib material layer;

(b2) performing a first exposure process to the first photo-resist layer; and (b3) performing a first development process to remove unexposed regions of the first photo-resist layer for forming the first, second, third bottom pattern layers.

4. The method according to claim 3, wherein the step (c) comprises the steps of:

(c1) forming a second photo-resist layer on the substrate;

(c2) performing a second exposure process to the second photo-resist layer; and (c3) performing a second development process to remove unexposed regions of the second photo-resist layer for forming the first, second, third middle pattern layers.

5. The method according to claim 4, wherein the step (d) comprises:

(d1) forming a third photo-resist layer on the the substrate;

(d2) performing a third exposure process to the third photo-resist layer; and (d3) performing a third development process to remove unexposed regions of the third photo-resist layer for forming the first, second, third top pattern layers.

6. The method according to claim 5 wherein the first, second, and third photo-resistor layers are photo-sensitive dry films.

7. The method according to claim 1, wherein the method of forming the bottom pattern layers, the middle pattern layers and the top pattern layers comprises step of:

forming a first photo-resist layer on the substrate;

performing a first exposure process to the first photo-resist layer;

forming a second photo-resist layer above the first photo-resist layer;

performing a second exposure process to the second photo-resist layer;

forming a third photo-resist layer above the second photo-resist layer;

performing a third exposure process to the third photo-resist layer; and performing a development process to remove unexposed regions of the first photo-resist layer, the second photo-resist layer, and the third photo-resist layer so as to form the bottom pattern layers, the middle pattern layers and the top pattern layers.

8. The method according to claim 7 wherein the first, second, and third photo-resistor layers are photo-sensitive dry films.

* * * * *